US008511927B2

(12) United States Patent
Houman

(10) Patent No.: US 8,511,927 B2
(45) Date of Patent: Aug. 20, 2013

(54) FLUID-POWERED ROTATING BATH ACCESSORY

(76) Inventor: Bruce Houman, Anaheim, CA (US)

( * ) Notice: Subject to any disclaimer, the term of this patent is extended or adjusted under 35 U.S.C. 154(b) by 626 days.

(21) Appl. No.: 12/545,735

(22) Filed: Aug. 21, 2009

(65) Prior Publication Data

US 2011/0044750 A1 Feb. 24, 2011

(51) Int. Cl.
*A46B 11/06* (2006.01)

(52) U.S. Cl.
USPC ..... 401/289; 15/28; 4/601

(58) Field of Classification Search
USPC ..... 401/289; 15/28, 29, 34, 35, 50.1, 15/52, 52.1, 87, 104.09, 250.22; 4/601, 606
See application file for complete search history.

(56) References Cited

U.S. PATENT DOCUMENTS 4,089,079 A * 5/1978 Nicholson ..... 15/29
4,228,558 A * 10/1980 Zhadanov ..... 15/29
4,780,922 A * 11/1988 Sanchez ..... 15/29
4,841,590 A * 6/1989 Terry et al. ..... 15/28
5,065,463 A * 11/1991 Le ..... 4/606
5,129,121 A * 7/1992 Gelman ..... 15/29
6,151,728 A * 11/2000 Wright et al. ..... 4/606
6,205,607 B1 * 3/2001 Tse ..... 15/29
7,665,171 B2 * 2/2010 Alexander et al. ..... 15/29
7,941,887 B2 * 5/2011 Tsai ..... 15/29

FOREIGN PATENT DOCUMENTS

GB 2387773 A * 10/2003

* cited by examiner

*Primary Examiner* — David Walczak
*Assistant Examiner* — Jennifer C Chiang
(74) *Attorney, Agent, or Firm* — Trentice V. Bolar

(57) ABSTRACT

A fluid-powered bath brush that uses the kinetic energy of moving water to operate skin-cleaning attachments. In one embodiment, the bath brush comprises a brush head member having at least one brush head housing, a water wheel, a first drive gear, a second drive gear and a brush element rotatably mounted thereon, an adaptor with an outlet side adapted to be connected to a showerhead and an inlet side adapted to be connected to a first fluid-dispensing means that carries water to the showerhead and contains a diverter which diverts the flow of water from the first fluid-dispensing means to the showerhead to the flow of water from the first fluid-dispensing means to the brush head member and a flexible second fluid-dispensing means containing at least two tubes for carrying water connecting the brush head member and the adaptor.

14 Claims, 5 Drawing Sheets

FLUID-POWERED ROTATING BATH ACCESSORY

BACKGROUND

1. Field

The present disclosure relates generally to bath accessories and more specifically to a fluid-powered bath accessory that allows the showerhead of a typical shower enclosure to continue to operate while the water powered bath accessory is being used.

2. Background

Numerous bath accessories have been provided in prior art that are adapted to be utilized by persons when using a bathtub or shower for washing the body. While these units may be suitable for the particular purpose that they address, they are not suitable for the purpose of the present invention as heretofore described. There exists a need for bath brushes that can be used in conjunction with existing bathroom hardware. Additionally, there exists a need to provide a fluid-powered bath brush that utilizes water pressure from the showerhead in a safe manner. There also exists a need to provide a fluid-powered bath brush that allows the showerhead to continue to operate when the bath brush is in use. There also exists the need to provide a plurality of drive methods for the bath brush. There also exists the need to provide a bath brush that is simple and easy to use, economical in cost to manufacture and operates in a rotary or oscillating motion while providing other benefits and advantages mentioned herein.

SUMMARY

A primary object of the present invention is to provide a fluid-powered bath accessory that will overcome the shortcomings of the prior art devices.

Another object is to provide a fluid-powered bath accessory that utilizes water pressure from a flexible hose assembly connected to a diverter valve at the showerhead, so as to drive a rotating or oscillating bath accessory in a safe manner.

An additional object is to provide a fluid-powered bath accessory that allows the showerhead of a typical shower enclosure to continue to operate when the bath accessory is in use by having a dual lumen assembly attached such that one lumen delivers water to the bath accessory and the other lumen returns water from the bath accessory to the showerhead.

A still further object is to provide a plurality of drive methods for the bath accessory. Method one is to use magnetic coupling between the bath accessory and the internal driven gear to eliminate water that is powering the bath accessory and prevent it from contaminating the bath accessory. Method two is a direct drive between the bath accessory and the internal driven gear wherein minor amounts of water powering the bath accessory are allowed to escape at the bath accessory.

A still further object is to construct the bath accessory such that it can operate the interchangeable head element in a rotating or oscillating motion.

A still further object is to provide a fluid-powered bath accessory in which the interchangeable head element is removable and replaceable so as to allow for the same or other types of body-cleaning devices to be attached.

A further object is to provide a fluid-powered bath accessory that is simple and easy to use.

A still further object is to provide a fluid-powered bath accessory that is economical in cost to manufacture.

In one embodiment of the present disclosure, a fluid-powered bath accessory is provided. The bath accessory comprises a head member having at least one head housing, wherein the head housing has an internal cavity, a water wheel, a first drive gear, a second drive gear and an interchangeable head element rotatably mounted thereon wherein the interchangeable head element includes a hex shaped shaft having a groove mounted O-ring; a showerhead adaptor with an externally threaded outlet side and an internally threaded inlet side, wherein the showerhead adaptor is adapted to divert the flow of water to the-fluid-dispensing means and a flexible single-structured fluid-dispensing means, containing at least two lumens for carrying water, that connects the head member and the showerhead adaptor; wherein the first drive gear has a diameter that is less than the second drive gear, the first drive gear being a single unit with the water wheel and in meshing engagement with the second gear; wherein the amount of space between the water wheel and head housing is adapted to provide a reduced clearance area at the sides and periphery of the head housing where water first enters the brush head housing, which significantly restricts water flow around a portion of the water wheel; wherein the second driven gear has a pivot shaft broached to a hex shaped into which the hex shaped shaft slides; and wherein the bath accessory is adapted to operate in conjunction with typical showerheads.

In one aspect of at least one embodiment of the present disclosure, the first drive gear of the bath accessory has a diameter that is less than the second drive gear of the bath accessory and the first drive gear is (a) formed on the longitudinal side of the water wheel thereby forming a single unit therewith and (b) in meshing engagement with the second gear.

In another aspect of at least one embodiment of the present disclosure, the amount of space between the water wheel and brush head housing is adapted to provide a reduced clearance area at the sides and periphery of the brush head housing where water first enters the brush head housing to significantly restrict the flow of water around the water wheel.

In yet another aspect of at least one embodiment of the present disclosure, the flexible fluid-dispensing means is made of a flexible to semi-flexible material.

In yet another aspect of at least one embodiment of the present disclosure, the second drive gear is in meshing engagement with the interchangeable head element.

In yet another aspect of at least one embodiment of the present disclosure, the showerhead adapter of the bath accessory allows water to flow to both a typical showerhead and the bath accessory at the same time.

In yet another aspect of at least one embodiment of the present disclosure, the flexible fluid-dispensing means is a multi-lumen Siamese hose.

In yet another aspect of at least one embodiment of the present disclosure, the flexible fluid-dispensing means is a plastic tube within another larger plastic tube.

In yet another embodiment, the bath accessory further comprises a valve or switch that allows water either to flow to the head member or to bypass the head member and return to the showerhead.

In yet another aspect of at least one embodiment of the present disclosure, the interchangeable head element includes a hex-shaped shaft that is in meshing engagement with the second drive gear.

In another embodiment of the present disclosure, a fluid-powered bath brush is provided, containing a brush element that provides an oscillating motion. The bath brush comprises a brush head member having at least one brush head housing, water wheel containing a pivot hole, a link arm, a drive plate and a brush element rotatably mounted on the brush head member, an adaptor with an outlet side adapted to be connected to a showerhead and an inlet side adapted to be connected to a first fluid-dispensing means that carries water to the showerhead and containing a diverter which diverts the flow of water from the first fluid-dispensing means to the showerhead to the flow of water from the first fluid-dispensing means to the brush head member and a flexible second fluid-dispensing means containing at least two tubes for carrying water connecting the brush head member and the adaptor.

In one aspect of at least one embodiment of the present disclosure, the link arm is operably connected to the pivot hole of the water wheel and operably connected to the drive plate which is in meshing engagement with the brush element.

In another aspect of at least one embodiment of the present disclosure, the amount of space between the water wheel and brush head housing is adapted to provide a reduced clearance area at the sides and periphery of the brush head housing where water first enters the brush head housing to significantly restrict the flow of water around the water wheel.

In yet another aspect of at least one embodiment of the present disclosure, the water wheel includes cup-shaped portions at the periphery of the water wheel.

In yet another aspect of at least one embodiment of the present disclosure, the cup-shaped portions of the water wheel are propelled by the water from the flexible fluid dispensing means, which causes the interchangeable head element to oscillate.

In yet another aspect of at least one embodiment of the present disclosure, the reduced clearance of the head housing significantly reduces the amount of space between the water wheel and head housing at the sides and periphery of the head housing where water from the fluid-dispensing means first enters the head housing to significantly restrict the flow of water around the water wheel.

Further objects and benefits can be appreciated by one of ordinary skill having reviewed the present disclosure in combination with the accompanying drawings.

DRAWINGS

The above-mentioned features and objects of the present disclosure will become more apparent with reference to the following description taken in conjunction with the accompanying drawings wherein like reference numerals denote like elements and in which.

DETAILED DESCRIPTION

Figure 1:
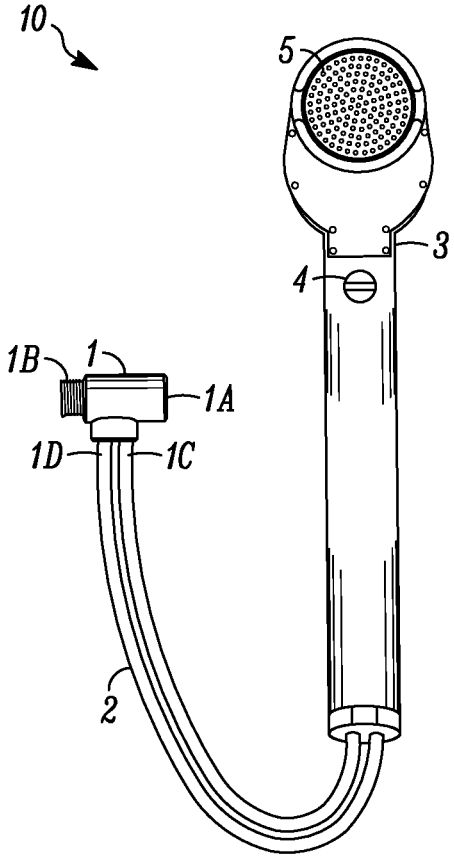
FIG. 1 is a top plan view of the bath accessory in accordance with at least one embodiment of the present disclosure.
Figure 2:
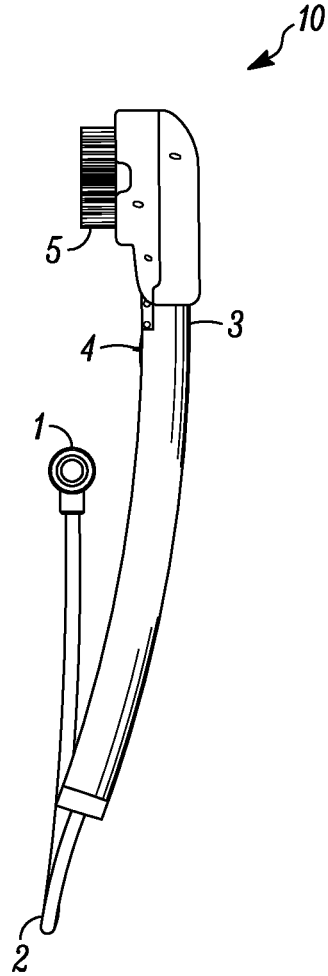
FIG. 2 is a side view of the bath accessory in accordance with at least one embodiment of the present disclosure.

In an embodiment of the present disclosure, as shown in FIGS. 1 and 2, a bath accessory 10 is provided, having an adapter 1 with an internally threaded inlet 1A. The inlet 1A is typically for the pipe or other vehicle that carries water (not shown) to which a typical showerhead is typically attached. The externally threaded outlet side 1B is where a typical showerhead attaches, allowing the showerhead and bath accessory 10 to work together seamlessly without the loss of any water.

In an aspect of at least one embodiment of the present disclosure, the showerhead adapter blocks off the flow of water to the showerhead and diverts the flow to the bath accessory 10. Water to the bath accessory 10 leaves the showerhead adapter through the outlet port 1C. Water from the bath accessory 10 returns to the inlet 1D and then to the showerhead.

In an aspect of at least one embodiment of the present disclosure, the hose 2 is a flexible to semi-flexible tube to carry water (e.g., plastic tubing) that connects the bath accessory 10 and the showerhead adapter. In another embodiment of the present innovation, the hose 2 is a multi-lumened Siamese hose.

The bath accessory 10 contains mechanical components that make the interchangeable head element 5, here a brush, rotate. In another embodiment of the present innovation, the bath accessory also contains an on-off valve or switch 4, which controls water flow to the bath accessory 10. In the "on" position, water flows to the water wheel mechanism and causes the interchangeable head element 5 to rotate, then the water is returned to the showerhead. In the "off" position, the water is allowed to bypass the interchangeable head element 5 mechanism and return directly to the showerhead.

Figure 3:
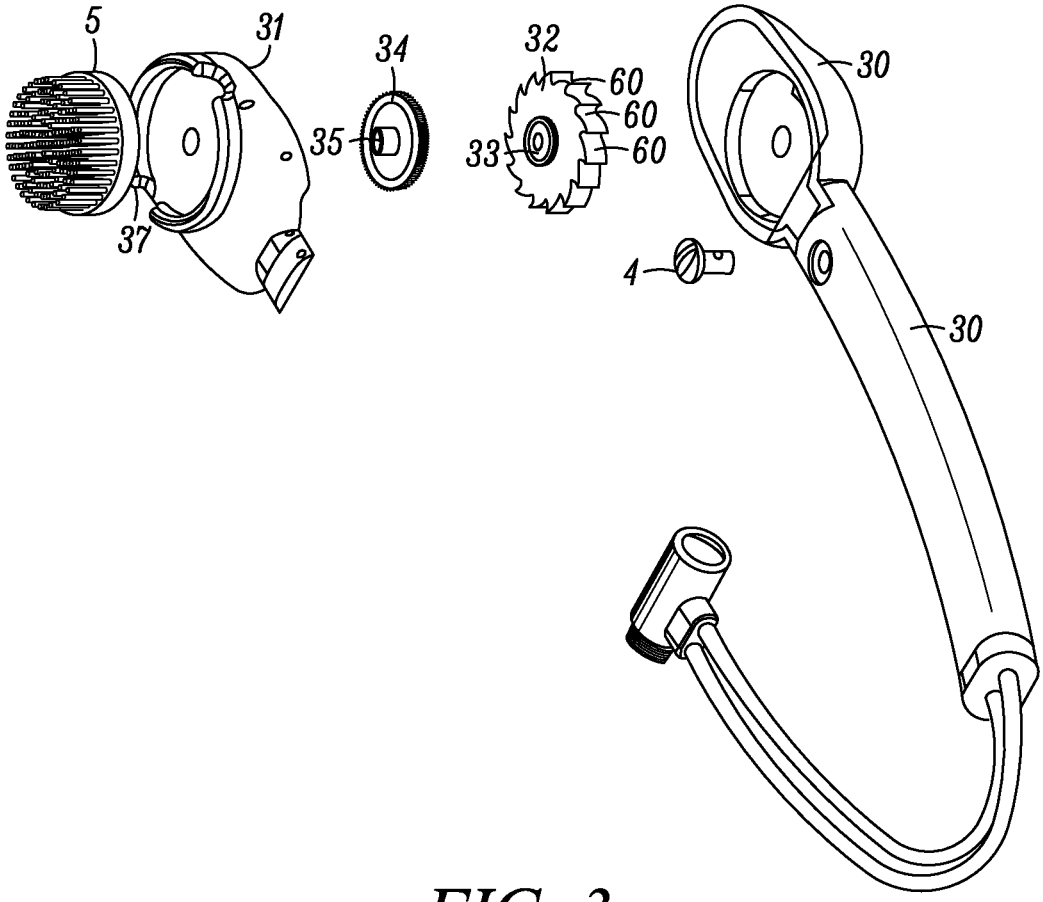
FIG. 3 is an exploded perspective view of the bath accessory in accordance with at least one embodiment of the present disclosure showing the various components of the head member in relation to each other.
Figure 4:
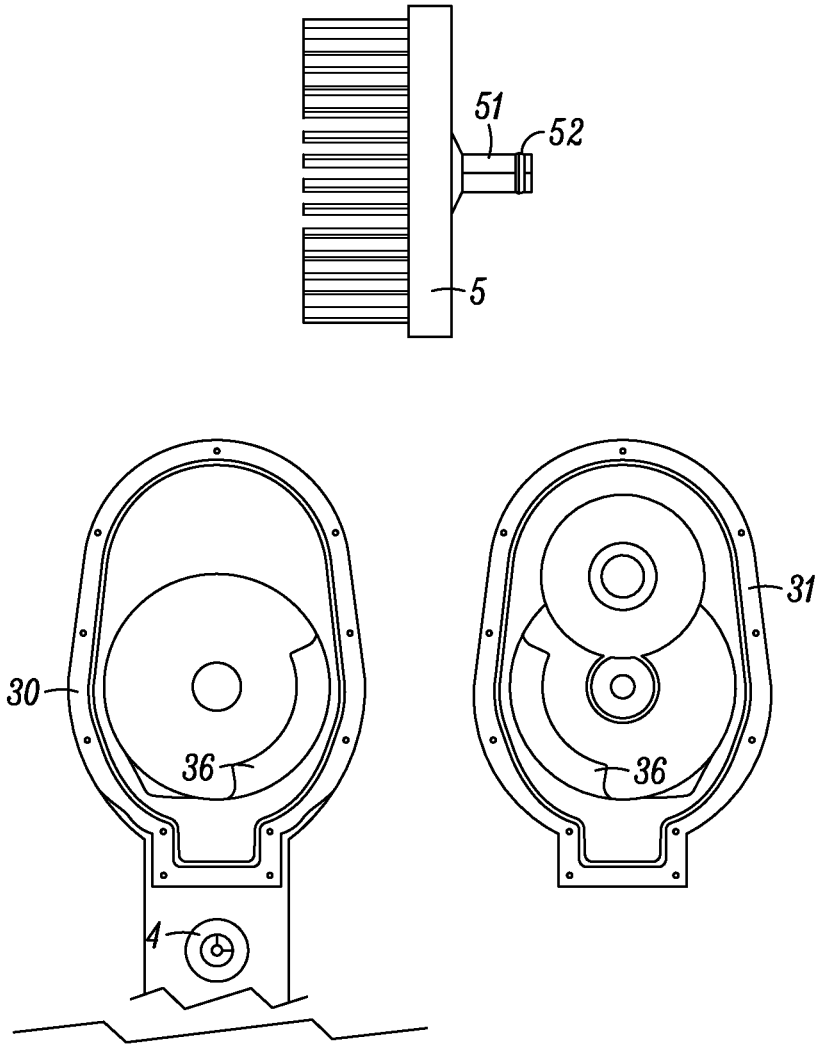
FIG. 4 is a top plan view of the head member internal cavity and separate interchangeable head element of at least one embodiment of the present disclosure.

In an aspect of at least one embodiment of the present disclosure, the housing of the bath accessory 10 has a curved or contoured area 37 on each side of the accessory to allow a thumb and forefinger to grasp the accessory and remove it. This allows for the placement of other interchangeable heads such as a stiffer brush, pumice stone abrasive, or other attachments to be used with the bath brush 10. As shown in FIGS. 3 and 4, the head housing 30 contains the passages for water to flow to and from the bath accessory, the cavity in which the water wheel 32 and the first drive gear 33 reside, the on-off valve or switch 4 and the attachment area for the upper housing 31.

In an aspect of at least one embodiment of the present disclosure, the upper housing 31 contains the second driven gear 34 with the pivot shaft broached to a hex shape 35 into which the interchangeable head element shaft 51 slides.

FIG. 4 illustrates the internal cavities of the head housing 30 and the upper housing 31. In an aspect of at least one embodiment of the present disclosure, there is a reduced clearance area 36 where the water first enters the bath accessory cavity. In order to achieve a highly efficient and effective water wheel, the clearance area at the sides and periphery must be as tight as possible.

Prior art attempts to achieve this involved making all of the cavity area as tight as possible. Unfortunately, the problem with that approach was that the tolerances required for manufacture made it difficult to impossible to meet for the entire cavity space and required significant time and expense. Additionally, the bath accessory 10 material would expand with heat, causing components to rub together, causing unwanted wear and malfunction. Alternatively, the material of the head 10 would shrink with cold water allowing the mechanism to stop due to too much clearance.

Figure 6:
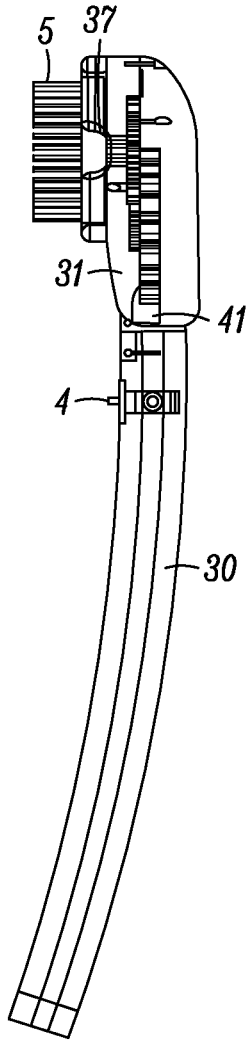
FIG. 6 is a side view of at least one embodiment of the bath accessory of the present disclosure showing the components of the bath accessory in relation to each other.
Figure 7:
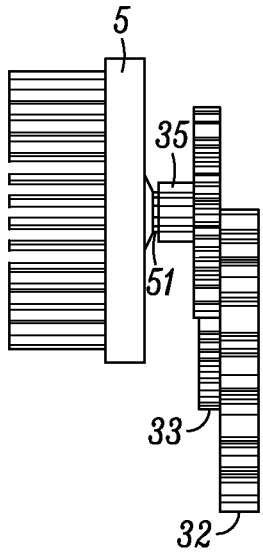
FIG. 7 is a side view of the interchangeable head element, first drive gear, water wheel, second drive gear and a portion of the hex-shaped shaft of the interchangeable head element.

As shown in FIGS. 3, 4, and 6, in another aspect of at least one embodiment of the present disclosure, this problem has been mitigated if not eliminated by creating a close tolerance at the entrance area of water into the cavity. The cup-shaped areas 60 on the diameter of the water wheel 32 are only effective where the water from the nozzle 41 and the reduced area 36 contacts the cups. Once the cup has cleared the water inlet area, it no longer provides energy to the water wheel 32 and the close tolerance is no longer needed.

In another embodiment of the present innovation, the interchangeable head element 5 is connected to the second drive gear 34 with a hex-shaped shaft 51. This allows the interchangeable head element 5 to be removed or inserted into second driven gear 35.

As shown in FIG. 4, in another aspect of at least one embodiment of the present disclosure, the far end of the shaft 51 has a groove cut into it to hold an O-ring 52. Among other things, the O-ring provides friction between the shaft and the driven gear so the brush will not fall out.

Figure 5:
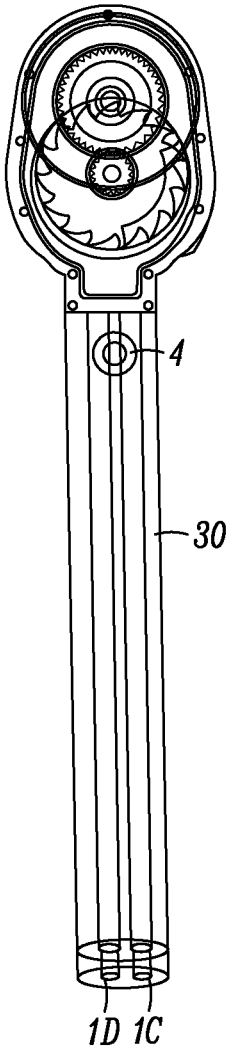
FIG. 5 is a top plan view of at least one embodiment of the bath accessory of the present disclosure showing the components of the bath accessory in relation to each other.

FIGS. 5 though 7 show the assembled position of the components that are shown in FIG. 3. The water inlet hose side 1C of the bath accessory has, just before it enters the cavity, a nozzle 41 causes the flow rate of the water to increase rapidly. This increased flow impinges on the cups of the water wheel causing the water wheel to spin.

As shown and demonstrated in FIGS. 1 through 7, the bath accessory 10 contains the mechanical components that make the interchangeable head element 5 rotate.

Figure 8:
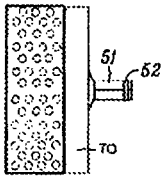
FIG. 8 is a side view of at least one embodiment of a pumice stone.

FIG. 8 illustrates a side view of at least one embodiment of the pumice stone interchangeable head which includes hex-shaped shaft 51 and o-ring 52.

It should be appreciated that the present disclosure provides numerous benefits and advantages. For example and not by way of limitation, one of the benefits provided by the bath accessory of the present disclosure is that it returns the water that powered the bath accessory back to the showerhead while still providing other various benefits and advantages discussed herein.

Bath accessories, such as a water-powered bath brush, typically releases the water that powered it around the head or out a port. The problem with this method is twofold. First, the user has to be careful of where the discharge water is going. Second the water discharging around the brush causes whatever bathing agent (e.g., soap or lotion) that is on the brush to be washed off. The water-powered bath accessory disclosed herein provides very little water discharge at the head. Among other things, the small amount of discharged water acts as a lubricant for the shaft driving the accessory and the bathing agents remain on the accessory.

The bath accessory of the present disclosure allows the removing and replacing of an interchangeable head element, such as a brush; this also allows the use of other types of interchangeable heads (e.g., a pumice stone head to remove calluses, a massaging brush and different brushes with various bristle lengths, stiffness, and sizes such as a small soft brush for facial cleaning).

The bath accessories of the present disclosure have various medical benefits and applications. For example and not by way of limitation, the bath accessory could be used by those with mobility problems (e.g., shoulder problems) and those who cannot reach their backs to wash when taking a shower. The present invention can also be used in hospitals, nursing homes and assisted care situations where a staff person needs to help bathe a patient or client. With the bath accessory of the present disclosure, the patient gets cleaner in less time, which is a benefit to both the patient and the staff.

It should be appreciated that the bath accessories of the present disclosure provide the added advantage that no electrical energy is used or wasted as it is run solely on water pressure. Furthermore, in various embodiments of the present disclosure, no water is wasted with the bath accessories of the present disclosure. The water used is cycled back through the showerhead and flows out through it as the user continues to bathe making it an environmentally friendly product that saves money over other bath accessory designs. It is also safe because it is powered only by water thereby eliminating the danger of electrical shock to the user.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A fluid powered bath accessory, the accessory comprising:

a) a head member having at least one head housing, wherein the head housing has an internal cavity, a water wheel, a first drive gear, a second drive gear and an interchangeable head element rotatably mounted thereon wherein the interchangeable head element includes a hex shaped shaft having a groove mounted O-ring;

b) a flexible single-structured fluid-dispensing means, containing at least two lumens for carrying water, that connects the head member and the showerhead adaptor; and c) a showerhead adaptor with an externally threaded outlet side and-an internally threaded inlet side, wherein the showerhead adaptor is adapted to divert the flow of water to the fluid-dispensing means;

wherein the first drive gear has a diameter that is less than the second drive gear, the first drive gear being a single unit with the water wheel and in meshing engagement with the second gear;

wherein the amount of space between the water wheel and head housing is adapted to provide a reduced clearance area at the sides and periphery of the head housing where water first enters the brush head housing, which significantly restricts water flow around a portion of the water wheel;

wherein the second driven gear has a pivot shaft broached to a hex shape into which the hex shaped shaft slides; and wherein the bath accessory is adapted to operate in conjunction with typical showerheads.

2. The bath accessory of claim 1, wherein the flexible fluid-dispensing means is made of plastic or a flexible to semi-flexible material.

3. The bath accessory of claim 1, wherein the second drive gear is in meshing engagement with the interchangeable head element.

4. The bath accessory of claim 1, wherein the showerhead adapter of the bath accessory allows water to flow to the outlet side and the bath accessory at the same time.

5. The bath accessory of claim 1, wherein the flexible single-structured fluid-dispensing means is a multi-lumened Siamese hose.

6. The bath accessory of claim 1, further comprising a valve or switch which allows water to either flow to the head member and the showerhead adaptor or to bypass the head member and return to the showerhead adaptor.

7. The bath accessory of claim 1, wherein the hex-shaped shaft is magnetically coupled to the second drive gear.

8. The bath accessory of claim 1, wherein the interchangeable head element is a brush element.

9. The bath accessory of claim 1, wherein the interchangeable head element is a pumice stone.

10. The bath accessory of claim 1, wherein the interchangeable head element is a massaging brush.

11. The bath accessory of claim 1, wherein the interchangeable head element is a soft brush for facial cleansing.

12. The bath accessory of claim 1, wherein the bath accessory further comprises at least two different interchangeable heads elements in the form a brush with differing bristle lengths, stiffness, and sizes.

13. The bath accessory of claim 1, wherein the second drive gear accepts various types of body-cleaning accessories.

14. A fluid-powered bath accessory comprising:

a) a head member having at least one head housing, wherein the head housing has an internal cavity, a water wheel, a first drive gear, a second drive gear and an interchangeable head element rotatably mounted thereon wherein the interchangeable head element includes a hex shaped shaft having a groove mounted O-ring;

b) a flexible single-structured fluid-dispensing means, containing at least two lumens for carrying water, that connects the head member and the showerhead adaptor; and c) a showerhead adaptor with an externally threaded outlet side and-an internally threaded inlet side, wherein the showerhead adaptor is adapted to divert the flow of water to the-fluid-dispensing means;

d) a valve or switch which allows water to either flow to the head member and the showerhead adaptor or to bypass the head member and return to the showerhead adaptor wherein the first drive gear has a diameter that is less than the second drive gear, the first drive gear being a single unit with the water wheel and in meshing engagement with the second gear;

wherein the amount of space between the water wheel and head housing is adapted to provide a reduced clearance area at the sides and periphery of the head housing where water first enters the brush head housing, which significantly restricts water flow around a portion of the water wheel;

wherein the second driven gear has a pivot shaft broached to a hex shaped into which the hex shaped shaft slides;

wherein the bath accessory is adapted to operate in conjunction with typical showerheads;

wherein the flexible fluid-dispensing means is made of plastic or a flexible to semi-flexible material;

wherein the second drive gear is in meshing engagement with the interchangeable head element;

wherein the showerhead adapter of the bath accessory allows water to flow to the outlet side and the bath accessory at the same time;

wherein the flexible single-structured fluid-dispensing means is a multi-lumened Siamese hose;

wherein the hex-shaped shaft is magnetically coupled to the second drive gear;

wherein the interchangeable head element includes a brush element, pumice stone, massaging brush, and a soft brush for facial cleansing;

wherein the bath accessory further comprises at least two different interchangeable heads elements in the form a brush with differing bristle lengths, stiffness, and sizes; and wherein the second drive gear accepts various types of body-cleaning accessories.

* * * * *